US005326106A

United States Patent [19]

Meyer

[11] Patent Number: 5,326,106

[45] Date of Patent: Jul. 5, 1994

[54] COMPOSITE IRON GOLF CLUB

[75] Inventor: Dean E. Meyer, LaGrange Park, Ill.

[73] Assignee: Wilson Sporting Goods Co., Chicago, Ill.

[21] Appl. No.: 74,586

[22] Filed: Jun. 11, 1993

[51] Int. Cl.[5] ..... A63B 53/04

[52] U.S. Cl. ..... 273/167 H; 273/80.3; 273/169; 273/173; 273/DIG. 23

[58] Field of Search ..... 273/77 R, 77 A, 162 R, 273/DIG. 23, 78, 167 R, 168, 169, 170, 171, 172, 173, 174, 175, 167 A, 167 B, 167 C, 167 D, 167 E, 167 F, 167 G, 167 H, 167 J, 167 K, 80.1-80.9, 193 R, 194 A

[56] References Cited

U.S. PATENT DOCUMENTS

| | | | |
|---|---|---|---|
| 1,480,961 | 1/1924 | Smith | 273/80.2 |
| 1,515,390 | 11/1924 | Hubbard . | |
| 2,231,847 | 2/1941 | Dickson . | |
| 4,632,400 | 12/1986 | Boone . | |
| 4,699,383 | 10/1987 | Kobayashi . | |
| 4,728,105 | 3/1988 | Kobayashi . | |
| 4,883,275 | 11/1989 | Boone | 273/172 |
| 4,995,609 | 2/1991 | Parente . | |
| 5,004,242 | 4/1991 | Iwanaga . | |
| 5,078,397 | 1/1992 | Aizawa . | |
| 5,226,659 | 7/1993 | Lo | 273/167 H |

FOREIGN PATENT DOCUMENTS

| | | | |
|---|---|---|---|
| 692197 | 8/1964 | Canada | 273/169 |
| 4-4108464 | 4/1992 | Japan | 273/167 R |
| 413392 | 7/1934 | United Kingdom | 273/167 R |
| 2146249 | 4/1985 | United Kingdom | 273/167 J |
| 2237998 | 5/1991 | United Kingdom | 273/80.2 |
| 2241173 | 8/1991 | United Kingdom | 273/80.2 |

*Primary Examiner*—Vincent Millin
*Assistant Examiner*—Sebastiano Passaniti

[57] ABSTRACT

An iron golf clubhead includes a blade which is formed from a first material and a hosel and a junction portion which are formed from a second material which is less dense than the material of the blade. The blade includes a toe end and a heel end and a flat bracket which extends from the heel end. The junction portion surrounds the bracket and is secured thereto.

17 Claims, 3 Drawing Sheets

COMPOSITE IRON GOLF CLUB

BACKGROUND

This invention relates to iron type golf clubs, and, more particularly, to an iron clubhead which is formed from two different materials.

An iron clubhead includes a blade, which includes the club face for striking a golf ball, and a hosel, to which the shaft is secured. A junction portion connects the hosel and the blade. Iron clubheads are conventionally forged or cast in a single, integral piece from metal or metal alloy.

Some clubheads are formed from two or more different materials. For example, a metal core can be covered with fiber-reinforced composite material, or the face and back of the clubhead can be formed from different materials. In such cases, however, the hosel and junction are generally formed integrally with a portion of the blade.

Each numbered golf iron, for example a 5 iron, has a standard weight which does not vary much between various manufacturers of golf clubs. A typical iron clubhead has about 78% of its weight in the blade area and about 22% of its weight in the junction area. Ball flight and distance is affected by the weight of the blade and the manner in which the weight is distributed in the blade. The weight in the hosel and the junction area has little or no effect on the ball.

Some clubs have redistributed weight from the hosel to the blade by forming openings or cutouts in the hosel. However, such openings interrupt the integrity of the hosel. Other clubs have reduced the length of the hosel or eliminated the hosel. However, the attachment of the shaft to the clubhead can be adversely affected.

SUMMARY OF THE INVENTION

The invention provides a composite iron clubhead in which the blade is formed of a first material and the hosel and hosel junction are formed from a second material which is less dense than the first material. Weight is thereby taken out of the hosel and junction and redistributed to the blade. The additional weight in the blade will have an advantageous effect on the flight and distance of the golf ball. The blade includes a toe end and a heel end and a relatively flat bracket which extends from the heel end. The bracket is provided with openings, and the material of the junction surrounds the bracket and extends through the openings.

DESCRIPTION OF THE DRAWINGS

The invention will be explained in conjunction with an illustrative embodiment shown in the accompanying drawing, in which.

DESCRIPTION OF SPECIFIC EMBODIMENT

Figure 1:
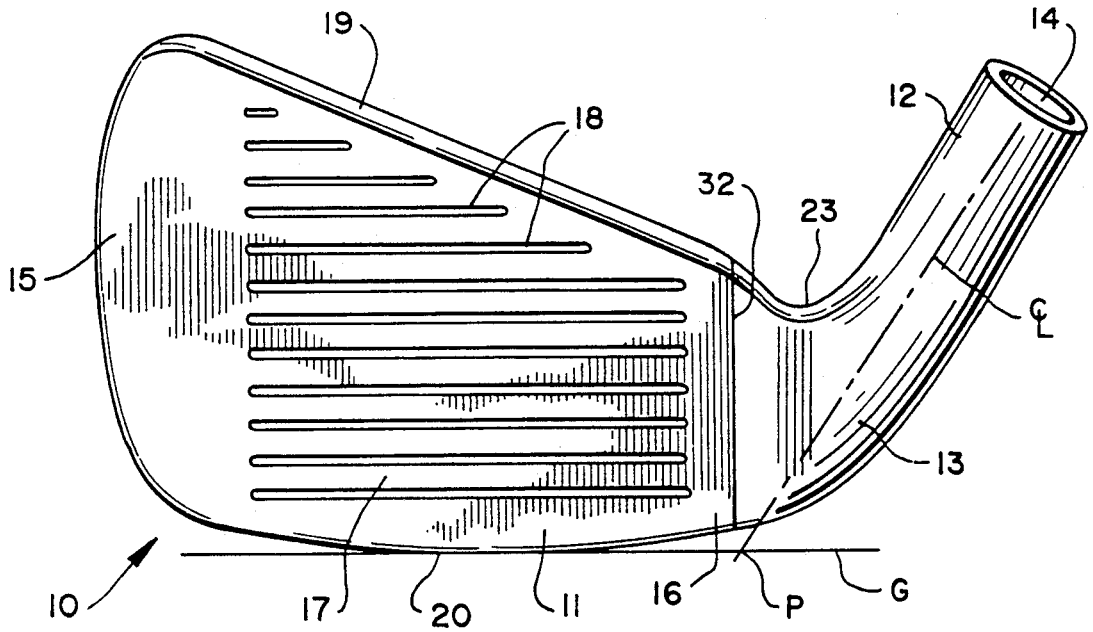
FIG. 1 is a front elevational view of a clubhead formed in accordance with the invention.
Figure 2:
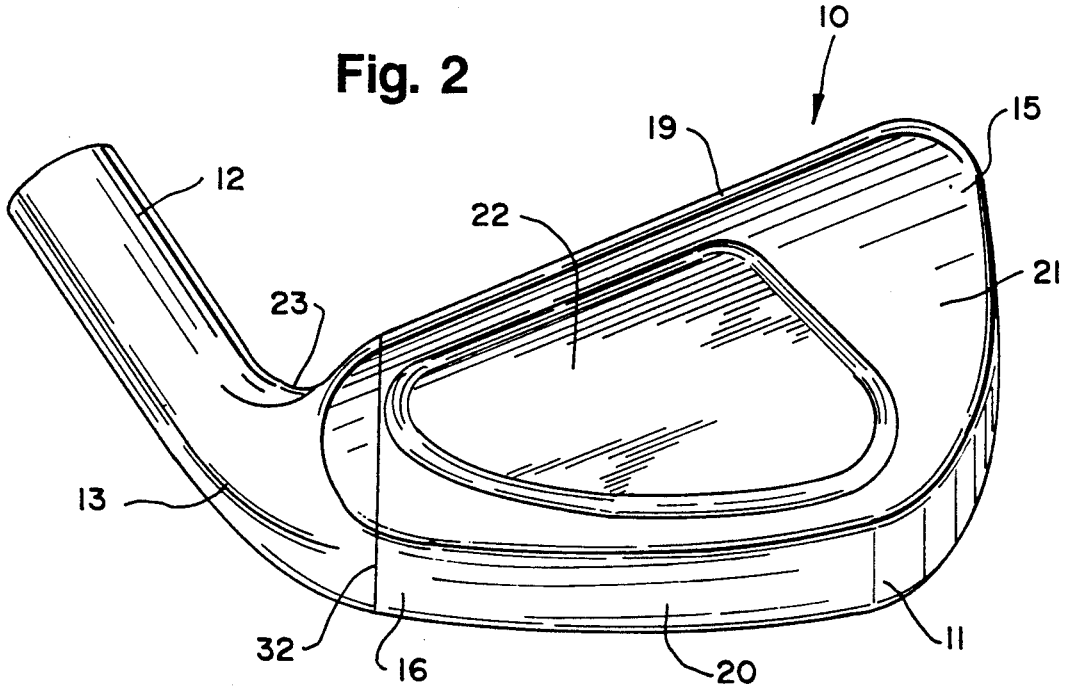
FIG. 2 is a rear elevational view of the clubhead.

Referring first to FIGS. 1 and 2, an iron type golf clubhead 10 includes a blade 11, a hosel 12, and a junction 13 which joins the hosel and the blade. The hosel is tubular or cylindrical and is provided with a bore 14 which is adapted to receive a conventional golf club shaft. The shaft is inserted into the hosel and secured therein in the conventional manner.

The blade 11 includes a toe end 15 and a heel end 16 and a flat face 17 which extends from the toe end to the heel end. A plurality of parallel grooves 18 are formed in the face in the conventional manner. The blade also includes a top edge 19, a sole 20, and a back surface 21. The particular clubhead illustrated includes a cavity 22 in the back surface. The bottom of the junction 13 curves upwardly from the sole of the blade, and the top of the junction includes a generally U-shaped notch 23.

The grooves 18 are usually designed so that they extend parallel to a ground plane G when the center of the sole rests on the ground in the proper address position. The toe ends of the grooves and the heel ends of the groove are aligned along lines which extend perpendicularly to the grooves.

Figure 5:
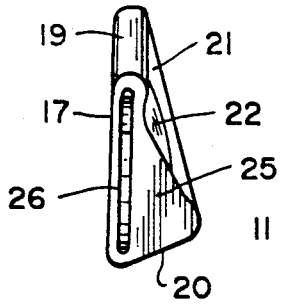
FIG. 5 is a side elevational view of the blade taken along the line 5—5 of FIG. 3.
Figure 3:
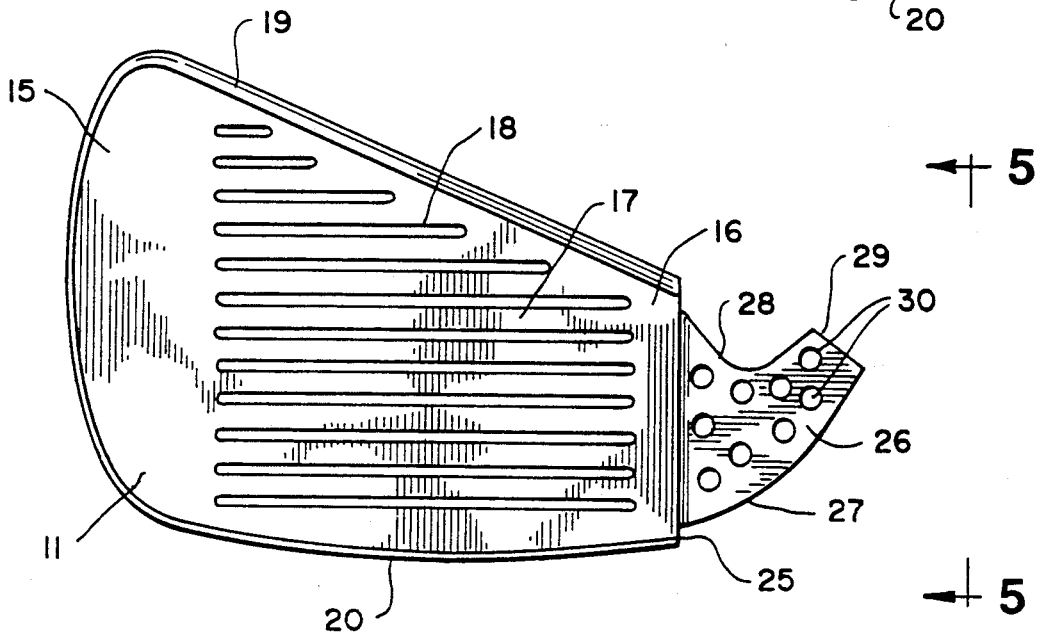
FIG. 3 is a front elevational view of the blade of the clubhead.
Figure 4:
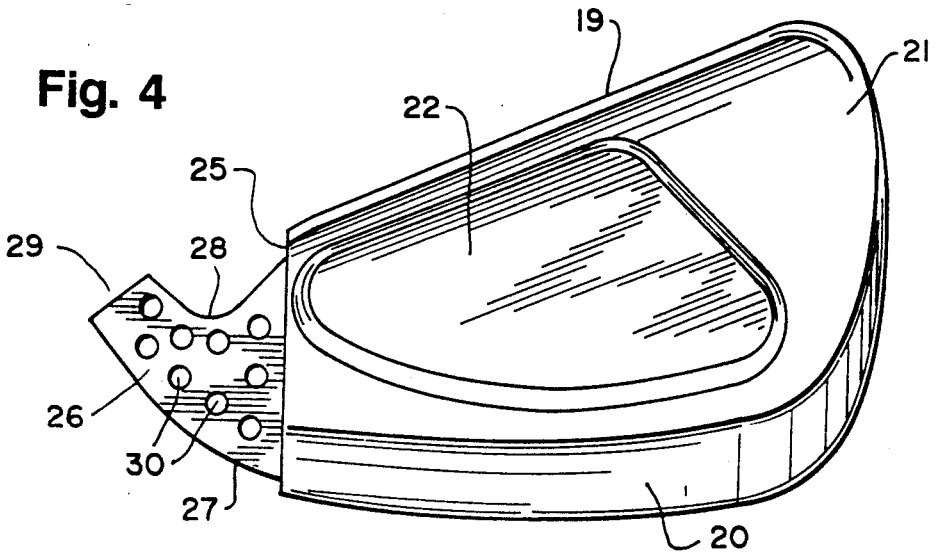
FIG. 4 is a rear elevational view of the blade.
Figure 6:
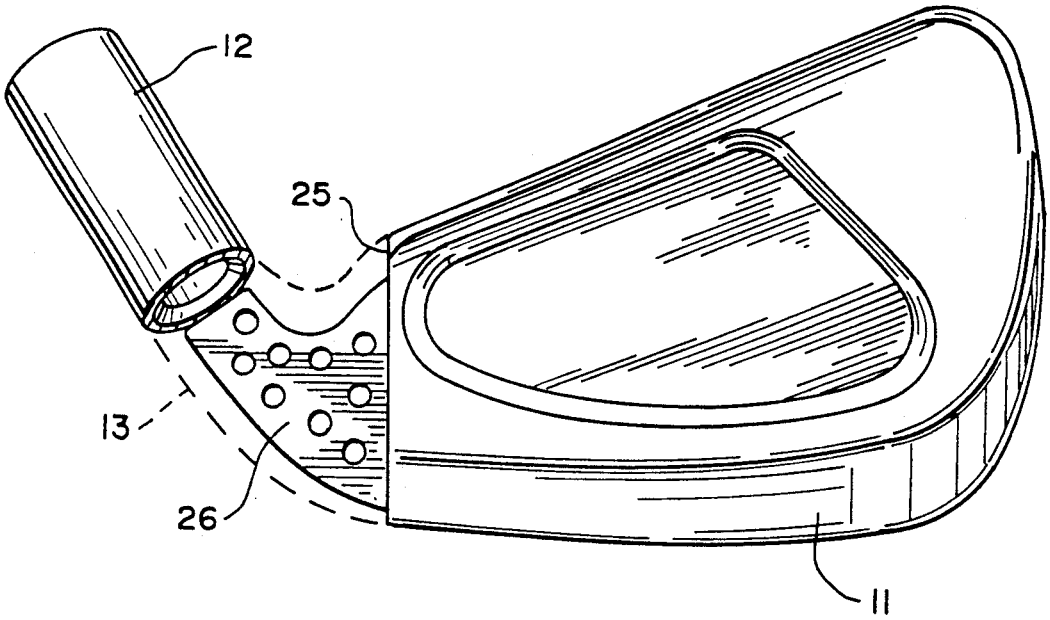
FIG. 6 is a view similar to FIG. 2 with the junction portion of the clubhead broken away.
Figure 7:
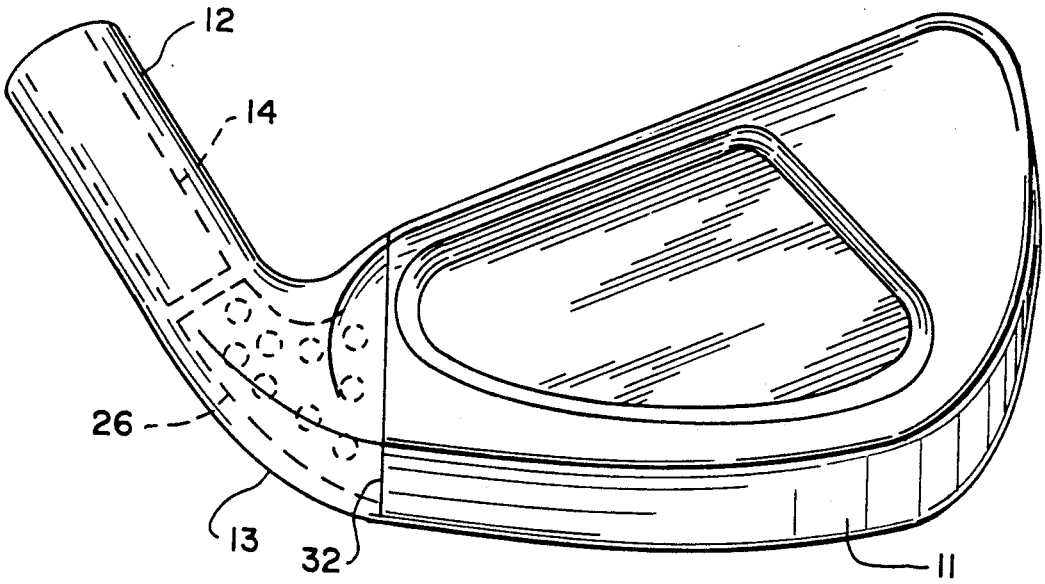
FIG. 7 is a view similar to FIG. 2 showing the bracket of the blade in dotted outline.

Referring now to FIGS. 3–5, the blade 11 is formed separately from the junction and the hosel. The heel end of the blade terminates in a flat end surface 25 which extends perpendicularly to the face 17 and the grooves 18. A flat, thin bracket 26 extends from the end surface 25 parallel to the face 17. As can be seen in FIG. 5, the thickness of the bracket is constant along the length of the bracket and the thickness of the bracket in a direction perpendicular to the face 17 is less than the thickness of the blade along the top edge 19.

The bracket has a curved bottom edge 27 and a U-shaped top edge 28 which conform generally to the contour of the junction 13. The bracket terminates in a straight end edge 29. A plurality of openings 30 are formed in the bracket.

The blade 11 can be formed by conventional forging or casting techniques. The bracket 26 is formed integrally with the remainder of the blade, and, if necessary, suitable finishing operations can be performed on the bracket to obtain the desired shape or openings. In the embodiment illustrated, the entire bracket is generally planar and extends parallel to the face 17. However, for irons which have an offset hosel, the bracket can curve forwardly beyond the face 17 so that the completed hosel will have the desired offset relative to the blade.

The material of the junction 13 and hosel 12 is cast or otherwise formed around the bracket 26 and abuts the flat end surface 25 of the blade. During formation of the junction, the molten or soft material of the junction flows through the openings 30 in the bracket to form a secure interconnection between the junction and the bracket. The bore of the hosel may be formed while the hosel is formed and extends substantially to the end 29 of the bracket. Alternatively, the material of the junction 13 and the hosel 12 can be joined to the blade at the surface 25 by welding, brazing, epoxy, copper flash, or mechanical fit.

The outer surface of the junction merges smoothly with the outer surface of the blade, and a seam line 32 is formed where the material of the junction meets the material of the blade. If desired, the seam line can be buffed to render the seam less perceptible. The seam line extends perpendicularly to the grooves 18. The flat end surface 25 and the seam line 32 are spaced about 0.10 to 0.20 inch, preferably about 0.15 inch, from the heel ends of the grooves and are substantially aligned with the intersection P (FIG. 1) between the axis or centerline CL of the hosel and the ground plane G.

The blade is formed from a relatively dense material, and the junction and hosel are formed from a less dense material so that the weight of the junction and hosel is less than the weight of the junction and hosel of a conventional club. The weight of the blade can therefore be increased while maintaining the overall weight of the clubhead within the traditional range. The extra weight in the blade can be used to increase the perimeter weighting of the cavity-backed blade and/or increase the mass behind the sweetspot of the face.

The material of the blade can be corrosion resistant stainless steel, beryllium copper alloy, or other conventional clubhead materials. The material of the hosel and junction can be aluminum, titanium, composite material such as fiber reinforced resin, e.g., graphite fibers and epoxy resin, or other material which is lighter than the material of the blade.

A typical number iron clubhead has about 78–80% of its weight in the blade area and about 20–22% of its weight in the hosel and junction area. By forming the clubhead in accordance with the invention, the weight distribution of the clubhead can be changed so that a substantially higher percentage of the weight of the clubhead is in the blade. For example, the weight distribution can be varied as desired so that from 80% to up to about 95% of the weight is in the blade and only about 20% to 5% is in the hosel and junction area. More preferably, the weight of the blade is between about 85 and 95% of the total weight of the clubhead, and the weight of the hosel and junction is between about 5 and 15% of the total weight. Even more preferably, the weight distribution is about 90% of the blade and about 10% in the hosel/junction area.

Table I describes the weight distribution of a prior art set of conventional Wilson Ultra iron clubheads.

TABLE I

| | Conventional Clubhead | | | | |
|---|---|---|---|---|---|
| No. of Iron | Total Weight (grams) | Weight in Blade (grams) | Weight in Hosel/ Junction (grams) | % of Weight in Blade | % of Weight in Hosel |
| 1 | 236.2 | 185.3 | 50.9 | 78.45 | 21.55 |
| 2 | 242.3 | 191.55 | 50.75 | 79.05 | 20.95 |
| 3 | 247.2 | 195.5 | 51.7 | 79.09 | 20.91 |
| 4 | 253.8 | 200.7 | 53.1 | 79.08 | 20.92 |
| 5 | 258.5 | 202.9 | 55.6 | 78.49 | 21.51 |
| 6 | 266.3 | 212.5 | 53.8 | 79.80 | 20.20 |
| 7 | 271.4 | 216.25 | 55.15 | 79.68 | 20.32 |
| 8 | 279.2 | 220.70 | 58.5 | 79.05 | 20.95 |
| 9 | 286.7 | 226.25 | 60.45 | 78.92 | 21.08 |
| PW | 296.4 | 235.05 | 61.35 | 79.32 | 20.20 |
| Sand Wedge | 322.9 | 253.8 | 69.1 | 78.60 | 21.40 |
| 60° Wedge | 315.2 | 245.35 | 69.85 | 77.84 | 22.16 |

By varying the materials which are used for the blade and for the hosel and junction, the weight distribution in the blade and the hosel/junction can be varied as desired while maintaining the overall weight of the clubhead within the standard range. For example, the clubheads in Table I were made from steel which has a density of 0.28 pounds per cubic inch. An advantageous material for the hosel/junction area is A206 aluminum, which has a density of only 0.101 pounds per cubic inch.

Dimensions and weights which are referred to herein may vary within standard manufacturing tolerances for cast and forged clubheads, for example about ±2%.

While in the foregoing specification, a detailed description of a specific embodiment of the invention was set forth for the purpose of illustration, it will be understood that many of the details herein given may be varied considerably by those skilled in the art without departing from the spirit and scope of the invention.

I claim:

1. An iron type golf clubhead having a blade, a hosel, and a junction portion which joins the blade and the hosel, the blade having a face for striking a golf ball, the blade being formed from a first material and the hosel being formed from a second material which is less dense than the first material, the blade including a toe end and a heel end and a bracket which extends from the heel end and which is thinner than the blade at the heel end, the junction portion surrounding the bracket and being secured thereto, the face being provided with parallel grooves which extend between the toe end and heel end of the blade, each groove having a toe end and a heel end, the heel end of the blade extending substantially perpendicularly to the heel ends of the grooves and being spaced about 0.10 to 0.20 inch from the heel ends of the grooves.

2. The clubhead of claim 1 in which the heel end of the blade is spaced about 0.15 inch from the heel ends of the grooves.

3. The clubhead of claim 1 in which the bracket is substantially flat.

4. The clubhead of claim 3 in which the bracket is provided with openings through which the material of the junction portion extends.

5. The clubhead of claim 1 in which the weight of the blade is from about 85 to 95% of the total weight of the clubhead and the weight of the hosel and junction portion is from about 5 to 15% of the total weight of the clubhead.

6. The clubhead of claim 1 in which the bracket is provided with an opening through which the material of the junction portion extends.

7. An iron type golf clubhead having a blade, a hosel, and a junction portion which joins the blade and the hosel, the blade being formed from a first material and the junction portion and the hosel being formed from a second material which is less dense than the first material, the blade having a face for striking a golf ball, a toe end, and heel end, and a bracket which extends from the heel end and which is thinner than the blade at the heel end and which is provided with openings, the junction portion surrounding the bracket and being secured thereto and the material of the junction portion extending through the openings in the bracket.

8. The clubhead of claim 7 in which the blade is formed from stainless steel.

9. The clubhead of claim 7 in which the junction portion of the hosel are formed from material selected from the class of aluminum, titanium, and fiber-reinforced resin.

10. The clubhead of claim 7 in which the bracket is essentially flat.

11. The clubhead of claim 7 in which the bracket includes curved top and bottom edges.

12. An iron type golf clubhead having:

an integrally formed blade which includes a face for striking a golf ball, a back, and to end, a heel end, a sole, a top edge, and a bracket which extends from the heel end and which is thinner than the blade at the heel end, a junction portion which is formed separately from the blade and which surrounds the bracket and is secured thereto, and a tubular hosel which is formed separately from the blade and which extends from the junction portion, the hosel having a bore which is adapted to receive a shaft, the blade being formed from a second material which is less dense than the first material.

13. The clubhead of claim 12 in which the blade is formed from stainless steel.

14. The clubhead of claim 12 in which the junction portion and the hosel are formed from material selected from the class of aluminum, titanium, and fiber-reinforced resin.

15. The clubhead of claim 12 in which the bracket is substantially flat.

16. The clubhead of claim 12 in which the bracket is provided with an opening through which the material of the junction portion extends.

17. The clubhead of claim 12 in which the bracket includes curved top and bottom edges.

* * * * *

UNITED STATES PATENT AND TRADEMARK OFFICE

CERTIFICATE OF CORRECTION

PATENT NO. : 5,326,106

DATED : July 5, 1994

INVENTOR(S) : Dean E. Meyer

It is certified that error appears in the above-identified patent and that said Letters Patent is hereby corrected as shown below:

Col. 4, line 67 change "to" to —toe—.

Col. 5, line 9 insert after "formed from a" the following —first material and the junction portion and the hosel being formed from a—.

Signed and Sealed this

Twentieth Day of September, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,326,106
DATED : July 5, 1994
INVENTOR(S) : Dean E. Meyer

It is certified that error appears in the above-indentified patent and that said Letters Patent is hereby corrected as shown below:

Column 5, lines 9-10, change,

"the blade being formed from a second material which is less dense than the first material."

to -- the blade being formed from a first material and the junction portion and the hosel being formed from a second material which is less dense than the first material. --.

Signed and Sealed this

Thirty-first Day of October 1995

Attest:

Bruce Lehman

BRUCE LEHMAN

Attesting Officer

Commissioner of Patents and Trademarks